United States Patent [19]

Schmied

[11] Patent Number: 4,570,853

[45] Date of Patent: Feb. 18, 1986

[54] SELF-CLEANING FUEL INJECTION VALVE

[75] Inventor: Kurt Schmied, Denkendorf, Fed. Rep. of Germany

[73] Assignee: Daimler-Benz Aktiengesellschaft, Stuttgart, Fed. Rep. of Germany

[21] Appl. No.: 536,980

[22] Filed: Sep. 29, 1983

[30] Foreign Application Priority Data

Sep. 29, 1982 [DE] Fed. Rep. of Germany ..... 3236046

[51] Int. Cl.[4] ..... F23D 14/50; B05B 15/02

[52] U.S. Cl. ..... 239/116; 239/533.3

[58] Field of Search ..... 239/533, 533.1–533.12, 239/584, 583, 123, 87, 115–118

[56] References Cited

U.S. PATENT DOCUMENTS

| | | | |
|---|---|---|---|
| 1,834,061 | 4/1930 | Joachim | 239/533.4 |
| 2,721,762 | 10/1955 | Bates | 239/118 |
| 4,164,203 | 8/1979 | Cavanaugh | 239/585 |
| 4,225,088 | 9/1980 | Kulke et al. | 239/533.8 |
| 4,284,043 | 8/1981 | Happel | 239/533.2 |
| 4,407,457 | 10/1983 | Seifert | 239/533.12 |

FOREIGN PATENT DOCUMENTS

| | | | |
|---|---|---|---|
| 28288 | 5/1981 | European Pat. Off. | 239/533.3 |
| 2147719 | 9/1971 | Fed. Rep. of Germany . | |
| 102198 | 12/1973 | Fed. Rep. of Germany . | |
| 2711392 | 9/1978 | Fed. Rep. of Germany | 239/533.9 |
| 3002129 | 9/1980 | Fed. Rep. of Germany | 239/533.3 |
| 69754 | 5/1980 | Japan | 239/533.9 |
| 57462 | 11/1969 | Poland | 239/117 |
| 2003550 | 3/1979 | United Kingdom | 239/533.8 |
| 2084248 | 4/1982 | United Kingdom | 239/533.9 |

*Primary Examiner*—Andres Kashnikow
*Assistant Examiner*—Kevin Weldon
*Attorney, Agent, or Firm*—Barnes & Thornburg

[57] ABSTRACT

A fuel injection nozzle is proposed with an opening needle opposed against the flow direction and in which a spring loaded abutment body is guided for longitudinal sliding movement, which body with its free end protrudes into a blind pocket reservoir of the nozzle after a successful injection. Before the beginning of the injection this blind pocket reservoir is opened to open injection holes with different injection directions branching off from the blind pocket reservoir. Through a nozzle embodiment of this kind the damaging space in the blind pocket reservoir is substantially avoided and the proportion of the unburned hydrocarbons is substantially reduced.

8 Claims, 2 Drawing Figures

SELF-CLEANING FUEL INJECTION VALVE

BACKGROUND AND SUMMARY OF THE INVENTION

The invention relates to a fuel injection nozzle for combustion engines of the type having a nozzle body, an injection needle slidably disposed in the nozzle body, and a reservoir space downstream of the injection needle seat.

It is known that the various legislators have established ever higher demands regarding the exhaust emissions from internal combustion engines. This is especially so for unburned hydrocarbons wherein a very low value has been prescribed, which through the prior art injection nozzles can scarcely be achieved. It is further known that after the closing of an injection nozzle after a successful injection, there is remaining fuel in the blind pocket reservoir, which does not take part fully in the combustion and is responsible in large measure for the undesirable hydrocarbon emmissions.

With injection nozzles with a minimum pocket reservoir (DE-OS No. 24 38 014), an abutment body formation effective at the injection nozzle tip is fully dived or extended into the pocket reservoir and there are resultant disadvantages in fuel efficiency and smoke. The remaining cross section between the pocket reservoir walls and the abutment body throttles the flow of fuel too strongly.

With injection nozzles of the so-called seating hole type nozzles (DE-OS No. 27 10 217)—provided with injection holes in the injection needle seat to open, they reduce the hydrocarbon emmission about approximately the half value, however, this form of embodiment is not disposed for an error free construction for series production. Injection nozzles of this kind fail by means of the nozzle tip rubbing off. A further disadvantage results because the strong turning of the combustion field out the slot at the cross section of the needle seat in the tip holes does not provide the full fuel pressure at the injection openings. The injection intensity is thereby reduced.

Good efficiency and smoke value is achieved only with optimal flow comparisons in the fuel nozzle. Thereby, it is furthermore necessary to have a nozzle with bottom pocket reservoirs.

The invention is based upon the problem to minimize the effects of the space in the pocket reservoir adjacent the fuel injection nozzle tip and simultaneously to increase the through flow characteristics at the needle seat.

According to the invention, a movable abutment body is slidably disposed in the injection needle to selectively block and free-up the reservoir space and the opening therefrom. The abutment body and needle are separated by a return spring biasing the abutment body to a position filling the reservoir space. The return spring and the pressure surfaces on the injection needle and abutment body are configured so that the reservoir space is free during initial injection and then the abutment body squeezes out any fuel in the reservoir space, thereby reducing engine hydrocarbon emissions.

Through the movement of the abutment body relative to the injection needle, the pocket reservoir is timely fully filled. To begin the injection, this abutment body is, either by means of the combustion room pressure of the engine, or through the fuel pressure in the pressure space, protruded into the injection nozzle. The pocket reservoir is then free and the fuel can stream unhindered into the tip holes, i.e., injection holes.

At the end of the injection procedure the injection nozzle closes in a normal manner and through the strength of the return spring, the outwardly moving abutment body (with respect to the injection needle) forces the remaining fuel within the pocket reservoir into the combustion room.

An illustrative example of the invention is shown in the drawing and is described in more detail below.

DETAILED DESCRIPTION OF THE DRAWINGS

Figure 1:
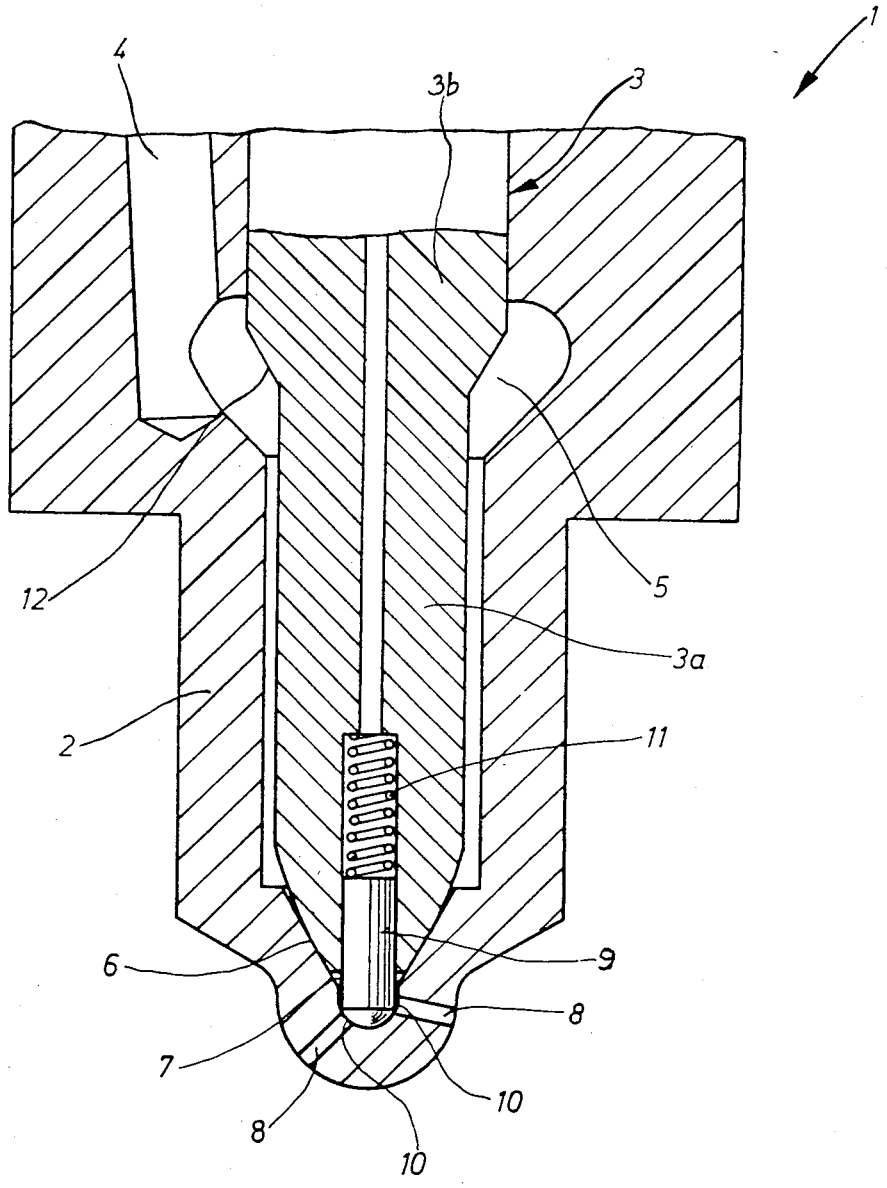
FIG. 1 is a longitudinal schematic sectional view through a fuel injection nozzle with a corresponding abutment body in the injection needle, movable by the combustion space pressure of the engine, constructed in accordance with a first preferred embodiment of the invention.

In FIG. 1 there is shown the lower part of a fuel injection nozzle 1 for a combustion engine, which includes a nozzle body 2 in which there is an injection needle 3, disposed against the flow direction of the fuel. A through bore 4 is provided which fuel from an unillustrated injection pump into the injection needle 3 and the surrounding pressure chamber 5. The injection nozzle exhibits a ball formed needle seat 6 as well as a pocket reservoir 7 (downstream) upstream of this needle seat 6. Injection openings 8 with different injection directions branch off at the reservoir 7, in this pocket reservoir 7 into which spring loaded abutment body 9 protrudes, which body 9 has a ball formed free end in the shape of the pocket reservoir 7, of the kind that it closes the through openings 10 of the holes 8.

The abutment body 9 is formed as a small piston guided for longitudinal slided movement in injection needle 3 against the force of a return spring 11 and extends itself as well as the return spring 11 being of approximately the same length, only over a small part of the smaller diameter and portion of the needle shaft 3*a*. The other connection from the small to the larger needle shaft 3*b* is by means of a pressure shoulder 12 formed in the pressure chamber 5, through which the injection needle 3 due to the incoming pressure waves lifts up from its ball formed needle seat 6. Prior to the lifting up of injection needle 3, the abutment body 9 is already pushed against the strength of the return spring 11 into the injection needle 3 by the effective combustion chamber pressure in the compression phase of the engine, so that the fuel can flow unhindered into the then free reservoir 7 and the injection holes 8.

As soon as the injection needle 3 is further lifted off of the needle seat 6, the abutment body 9 is again protruding outwardly of the needle shaft 3*a* into the reservoir hole 7 and presses aside the hazardous remaining fuel.

Figure 2:
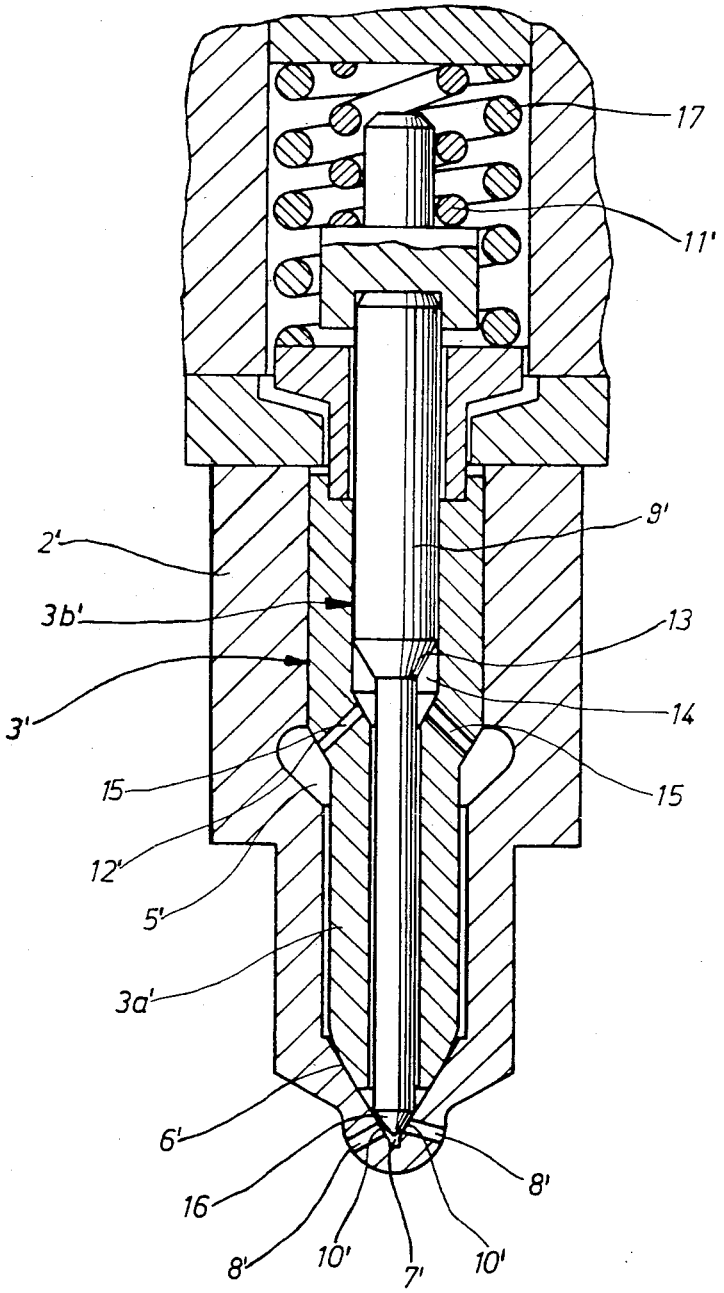
FIG. 2 is a longitudinal schematic sectional view through a fuel injection nozzle, which has a correspondingly guided abutment body in the injection needle which is biased by the fuel pressure in the nozzle, constructed in accordance with a second preferred embodiment of the invention.

With the embodiment according to FIG. 2 the abutment body 9' is guided, not through the combustion chamber pressure of the combustion engine as in the FIG. 1 embodiment, but rather, as well as the injection needle 3'—through the injection pressure of the injection system. In FIG. 2, corresponding parts as in the FIG. 1 embodiment are designated with primed reference characters. The abutment body 9' is therefore formed as an abutment needle with pressure shoulder 13, which borders pressure space 14, which is disposed between the nozzle needle 3' and the abutment needle 9' and is connected by means of connecting bores 15 with the surrounding pressure chamber 5' at the nozzle needle 3'. The abutment needle 9' extends itself over the entire length of the injection needle 3' and protrudes with its needle point 16 into the reservoir pocket 7'. The return spring 11' for the abutment needle 9' is arranged concentrically to the closing spring 17 for the nozzle 3'. The abutment needle 9' is so pretensioned that it is lifted by the injection system oncoming pressure waves to at first open the reservoir 7'. Subsequently the injection pressure opens the nozzle needle 3. The return spring 11' acts to subsequently force the needle 9' to squeeze out the fluid in reservoir 7, at the end of the injection.

Although the present invention has been illustrated in detail, it is to be clearly understood that the same is by way of example only and is not be taken by way of limitation. The spirit and scope of the invention are to be limited only by the claims.

I claim:

1. Fuel injection nozzle arrangement for an internal combustion engine, comprising:

a nozzle body;

an injection needle movably disposed in the nozzle body and engageable with a needle seat at the nozzle body, a pocket reservoir formed at the downstream end of the needle seat, injection holes with different injection directions extending from the pocket reservoir such that a bottom surface of the pocket reservoir lies below a level at which the injection holes open into said reservoir, allowing fuel to be trapped in said reservoir following an injection cycle;

an abutment body movably disposed in the needle between a first position blocking the pocket reservoir and a second position freeing the pocket reservoir, said abutment body extending into an area of the reservoir adjacent to the injection holes to at least partially block said injection holes and to substantially fill said reservoir when said abutment body is in said first position;

abutment body biasing means for biasing said abutment body toward said first position blocking the pocket reservoir, and;

wherein said abutment body, injection needle and biasing means are configured so that said abutment body is removed to the second position prior to movement of the injection needle to begin the injection cycle, and wherein said abutment body is moved to the first position immediately following the injection cycle to force the trapped fuel from the reservoir.

2. Arrangement according to claim 1, wherein said biasing means is a return spring interposed between the abutment body and the injection needle.

3. Arrangement according to claim 2, wherein the return spring, which is disposed at the back side of the abutment body, is provided in the lower half of the needle shaft of the injection needle, and wherein the abutment body is moved against the return spring by means of the combustion space pressure of the engine during the compression phase.

4. Arrangement according to claim 2, with through bores extending in the nozzle body and leading to a pressure chamber surrounding the injection needle, wherein the abutment body itself extends over the entire length of the injection needle and exhibits a pressure shoulder for effecting lifting of the abutment body via the fuel pressure, which pressure shoulder is disposed in the region of one of the pressure spaces formed out of the injection needle and the abutment body, and wherein at least one connecting bore is connected with the chamber surrounding the injection needle adjacent the pressure shoulder.

5. Arrangement according to claim 2, wherein the abutment body is disposed to mate with the form of the reservoir at its free end.

6. Arrangement according to claim 3, wherein the abutment body is disposed to mate with the form of the reservoir at its free end.

7. Arrangement according to claim 4, wherein the abutment body is disposed to mate with the form of the reservoir at its free end.

8. Arrangement according to claim 5, wherein the branching injection holes from the reservoir are closeable by means of the abutment body.

* * * * *

UNITED STATES PATENT AND TRADEMARK OFFICE

CERTIFICATE OF CORRECTION

PATENT NO. : 4,570,853

DATED : February 18, 1986

INVENTOR(S) : Kurt Schmied

It is certified that error appears in the above-identified patent and that said Letters Patent is hereby corrected as shown below:

Column 2, Line 37, delete "(downstream) upstream" and insert --downstream--.

Column 4, Claim 1, Line 8, delete "removed" and insert --moved--.

Signed and Sealed this

*Twenty-seventh* Day of *May 1986*

[SEAL]

*Attest:*

DONALD J. QUIGG

*Attesting Officer*

*Commissioner of Patents and Trademarks*